US010947086B2

(12) United States Patent
Nichols et al.

(10) Patent No.: US 10,947,086 B2
(45) Date of Patent: Mar. 16, 2021

(54) SEQUENCE TRIGGERING FOR AUTOMATIC CALLS AND MULTI SEGMENT ELEVATOR TRIPS

(71) Applicant: OTIS ELEVATOR COMPANY, Farmington, CT (US)

(72) Inventors: Stephen Richard Nichols, Plantsville, CT (US); Bradley Armand Scoville, Farmington, CT (US); Harrison Daniels, Avon, CT (US); Paul A. Simcik, Southington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 539 days.

(21) Appl. No.: 15/855,495

(22) Filed: Dec. 27, 2017

(65) Prior Publication Data

US 2019/0161317 A1 May 30, 2019

Related U.S. Application Data

(60) Provisional application No. 62/593,017, filed on Nov. 30, 2017.

(51) Int. Cl.
*B66B 1/46* (2006.01)
*B66B 1/24* (2006.01)

(52) U.S. Cl.
CPC ..... *B66B 1/468* (2013.01); *B66B 1/2408* (2013.01); *B66B 2201/103* (2013.01); *B66B 2201/4653* (2013.01)

(58) Field of Classification Search
CPC . B66B 1/468; B66B 1/2408; B66B 2201/103; B66B 2201/4653
(Continued)

(56) References Cited

U.S. PATENT DOCUMENTS 5,952,626 A * 9/1999 Zaharia ..... B66B 1/468 187/381
5,984,051 A 11/1999 Morgan et al.
(Continued)

FOREIGN PATENT DOCUMENTS

CN 103863911 6/2014
CN 104418186 3/2015
(Continued)

OTHER PUBLICATIONS

European Search Report for application 18209160.3, dated May 8, 2019, 9 pages.
(Continued)

*Primary Examiner* — David S Warren
(74) *Attorney, Agent, or Firm* — Cantor Colburn LLP

(57) ABSTRACT

A computer-implemented method a sequence triggering of a call for an elevator car of an elevator system. The elevator system including a first location device and a second location device. The computer-implemented method including detecting, by the first location device, a signal by the mobile device and detecting, by the second location device, the signal by the mobile device. The computer-implemented method also including automatically executing, by the elevator system, the call for the elevator car in response to the detection by the second location device of the signal subsequent to the detection of the signal by the first location device.

18 Claims, 7 Drawing Sheets

(58) Field of Classification Search
USPC ..... 187/380
See application file for complete search history.

(56) References Cited

U.S. PATENT DOCUMENTS

| | | | | |
|---|---|---|---|---|
| 6,109,396 | A * | 8/2000 | Sirag | B66B 1/468 187/381 |
| 6,655,501 | B2 | 12/2003 | Kostka | |
| 7,162,233 | B2 | 1/2007 | Chiba | |
| 7,360,629 | B2 | 4/2008 | Hagi et al. | |
| 7,377,364 | B2 | 5/2008 | Ylinen | |
| 7,610,995 | B2 | 11/2009 | Ylinen | |
| 7,694,781 | B2 | 4/2010 | Sorsa et al. | |
| 8,047,333 | B2 | 11/2011 | Finschi | |
| 8,136,636 | B2 | 3/2012 | Bahjat et al. | |
| 8,151,942 | B2 | 4/2012 | Jaervinen | |
| 8,177,036 | B2 | 5/2012 | Stanley | |
| 8,205,722 | B2 * | 6/2012 | Suihkonen | B66B 1/2458 187/383 |
| 8,387,756 | B2 | 3/2013 | Laihanen et al. | |
| 8,485,317 | B2 | 7/2013 | Gerstenkorn et al. | |
| 8,505,692 | B2 | 8/2013 | Tokura et al. | |
| 8,744,754 | B2 | 6/2014 | Kappeler | |
| 8,939,263 | B2 | 1/2015 | Tokura | |
| 9,323,232 | B2 * | 4/2016 | Blom | H04W 4/029 |
| 9,726,746 | B2 | 8/2017 | Said | |
| 9,764,923 | B2 * | 9/2017 | Finschi | B66B 9/00 |
| 9,790,053 | B2 * | 10/2017 | Kuroda | B66B 1/468 |
| 10,017,355 | B2 * | 7/2018 | Silvennoinen | B66B 1/2408 |
| 10,207,893 | B2 * | 2/2019 | Elomaa | B66B 1/468 |
| 10,259,682 | B2 * | 4/2019 | Blom | H04W 4/029 |
| 10,273,117 | B2 * | 4/2019 | Buckman | H04W 4/80 |
| 10,392,224 | B2 * | 8/2019 | Peterson | B66B 1/46 |
| 2007/0041352 | A1 * | 2/2007 | Frankel | B66B 1/468 370/338 |
| 2007/0080027 | A1 * | 4/2007 | De Jong | B66B 1/2458 187/383 |
| 2011/0200023 | A1 * | 8/2011 | Murray | G01S 5/02 370/338 |
| 2013/0048436 | A1 * | 2/2013 | Chan | B66B 1/2408 187/387 |
| 2016/0035161 | A1 * | 2/2016 | Friedli | E05F 15/79 340/5.28 |
| 2016/0130113 | A1 | 5/2016 | Tokura | |
| 2016/0207735 | A1 * | 7/2016 | Elomaa | B66B 13/146 |
| 2016/0236903 | A1 * | 8/2016 | Blom | B66B 1/468 |
| 2016/0292522 | A1 * | 10/2016 | Chen | G01S 17/89 |
| 2016/0325962 | A1 | 11/2016 | Blandin et al. | |
| 2017/0010099 | A1 * | 1/2017 | Simcik | G01S 1/08 |
| 2017/0088397 | A1 * | 3/2017 | Buckman | B66B 1/468 |
| 2017/0313546 | A1 | 11/2017 | King | |
| 2018/0072535 | A1 * | 3/2018 | Hiltunen | B66B 1/468 |
| 2018/0319630 | A1 * | 11/2018 | Dayrell | B66B 1/2466 |
| 2019/0002237 | A1 * | 1/2019 | Scoville | B66B 1/468 |
| 2019/0161316 | A1 * | 5/2019 | Nichols | B66B 1/468 |
| 2019/0161317 | A1 * | 5/2019 | Nichols | B66B 1/468 |
| 2019/0168993 | A1 * | 6/2019 | Kuenzi | B66B 5/0012 |
| 2019/0185291 | A1 * | 6/2019 | Larmuseau | H04W 52/283 |
| 2019/0263626 | A1 * | 8/2019 | Daniels | B66B 1/3461 |
| 2019/0263627 | A1 * | 8/2019 | Huang | H04W 4/33 |
| 2019/0292012 | A1 * | 9/2019 | Scoville | B66B 1/2408 |
| 2020/0062537 | A1 * | 2/2020 | Suzuki | B66B 1/3446 |

FOREIGN PATENT DOCUMENTS

| | | | |
|---|---|---|---|
| CN | 104936878 | A | 9/2015 |
| CN | 205932779 | U | 2/2017 |
| CN | 107108149 | A | 8/2017 |
| CN | 202337620 | U | 12/2017 |
| JP | 5413096 | B2 | 2/2014 |
| JP | 2015003785 | A | 1/2015 |
| WO | 09132696 | | 11/2009 |
| WO | 2015049414 | A1 | 4/2015 |
| WO | 16146357 | | 9/2016 |
| WO | 17144384 | | 8/2017 |

OTHER PUBLICATIONS

European Search Report for application 18209163.7, dated May 7, 2019, 8 pages.

Chinese Office Action for Application No. 201811443539.9; dated Dec. 23, 2020; 11 Pages.

* cited by examiner

SEQUENCE TRIGGERING FOR AUTOMATIC CALLS AND MULTI SEGMENT ELEVATOR TRIPS

CROSS-REFERENCE TO RELATED APPLICATIONS

This application claims the benefit of U.S. Patent Provisional Application No. 62/593,017, filed Nov. 30, 2017, which is incorporated herein by reference in its entirety.

BACKGROUND

In present high rise buildings, conventional elevator systems require passengers to take multi-segment trips (e.g., ride multiple elevators) to get to their destination. In turn, the conventional elevator systems of the high rise buildings require the passengers to learn a layout of the high rise buildings (e.g., which elevators serve which floors) to initiate and accomplish these multi-segment trips. Multi-segment trips are challenging and add a level of complication to elevator travel, especially to visitors who are new to a particular high rise building.

BRIEF DESCRIPTION

In accordance with one or more embodiments, the computer-implemented method for a sequence triggering of a call for an elevator car of an elevator system is provided. The elevator system includes a first location device and a second location device. The computer-implemented method includes detecting, by the mobile device, a first triggering signal by the first location device; detecting, by the mobile device, a second triggering signal by the second location device subsequent to the detection of the first triggering signal; automatically executing, by the mobile device, the call for the elevator car of the elevator system in response to the detection of the second triggering signal subsequent to the detection of the first triggering signal.

In accordance with one or more embodiments or the above computer-implemented method embodiment, the call for the elevator can be one of a plurality of calls of a multi-segment elevator trip within the elevator system.

In accordance with one or more embodiments or any of the above computer-implemented method embodiments, the program instructions can be further executable by the processor to cause an automatically executing of an initial call for a first elevator car of the elevator system in response to the first triggering signal.

In accordance with one or more embodiments or any of the above computer-implemented method embodiments, the call for the elevator car can correspond to a subsequent segment of the multi-segment elevator trip, and the first call for the first elevator car can correspond to a first segment of the multi-segment elevator trip.

In accordance with one or more embodiments or any of the above computer-implemented method embodiments, the first location device can be located in a first elevator lobby providing access to the elevator car.

In accordance with one or more embodiments or any of the above computer-implemented method embodiments, the second location device can be located in a shared elevator lobby providing access to the elevator car, or the second location device can be located within the elevator car.

In accordance with one or more embodiments or any of the above computer-implemented method embodiments, the first location device can be located within the elevator car.

In accordance with one or more embodiments or any of the above computer-implemented method embodiments, the first location device can be located within an elevator fixture.

In accordance with one or more embodiments or any of the above computer-implemented method embodiments, the mobile device can provide a user interface indicating a status of the multi-segment trip.

In accordance with one or more embodiments or any of the above computer-implemented method embodiments, the detecting of the first and second triggering signals and the automatically executing of the call by the mobile device can be hands-free operations with respect to the mobile device and a user thereof.

In accordance with one or more embodiments, a mobile device including a memory and a processor is provided. The memory stores program instructions for a sequence triggering of a call for an elevator car of an elevator system thereon. The elevator system includes a first location device and a second location device. The program instructions executable by the processor to cause detecting, by the mobile device, a first triggering signal by the first location device; detecting, by the mobile device, a second triggering signal by the second location device subsequent to the detection of the first triggering signal; automatically executing, by the mobile device, the call for the elevator car of the elevator system in response to the detection of the second triggering signal subsequent to the detection of the first triggering signal.

In accordance with one or more embodiments or the above mobile device embodiment, the call for the elevator can be one of a plurality of calls of a multi-segment elevator trip within the elevator system.

In accordance with one or more embodiments or any of the above mobile device embodiments, the program instructions can be further executable by the processor to cause an automatically executing of an initial call for a first elevator car of the elevator system in response to the first triggering signal.

In accordance with one or more embodiments or any of the above mobile device embodiments, the call for the elevator car can correspond to a subsequent segment of the multi-segment elevator trip, and the first call for the first elevator car can correspond to a first segment of the multi-segment elevator trip.

In accordance with one or more embodiments or any of the above mobile device embodiments, the first location device can be located in a first elevator lobby providing access to the elevator car.

In accordance with one or more embodiments or any of the above mobile device embodiments, the second location device can be located in a shared elevator lobby providing access to the elevator car, or the second location device can be located within the elevator car.

In accordance with one or more embodiments or any of the above mobile device embodiments, the first location device can be located within the elevator car.

In accordance with one or more embodiments or any of the above mobile device embodiments, the first location device can be located within an elevator fixture.

In accordance with one or more embodiments or any of the above mobile device embodiments, the mobile device can provide a user interface indicating a status of the multi-segment trip.

In accordance with one or more embodiments or any of the above mobile device embodiments, the detecting of the first and second triggering signals and the automatically executing of the call by the mobile device can be hands-free operations with respect to the mobile device and a user thereof.

In accordance with one or more embodiments, a computer-implemented method for a sequence triggering of a call for an elevator car of an elevator system is provided. The elevator system includes a first location device and a second location device. The computer-implemented method includes detecting, by the first location device, a signal by the mobile device; detecting, by the second location device, the signal by the mobile device; automatically executing, by the elevator system, the call for the elevator car in response to the detection by the second location device of the signal subsequent to the detection of the signal by the first location device.

In accordance with one or more embodiments or the above method embodiment, the call for the elevator can be one of a plurality of calls of a multi-segment elevator trip within the elevator system.

In accordance with one or more embodiments or any of the above method embodiments, the program instructions can be further executable by the processor to cause an automatically executing of an initial call for a first elevator car of the elevator system in response to the detection of the signal by the first location device.

In accordance with one or more embodiments or any of the above method embodiments, the call for the elevator car can correspond to a subsequent segment of the multi-segment elevator trip, and the first call for the first elevator car can correspond to a first segment of the multi-segment elevator trip.

In accordance with one or more embodiments or any of the above method embodiments, the first location device can be located in a first elevator lobby providing access to the elevator car.

In accordance with one or more embodiments or any of the above method embodiments, the second location device can be located in a shared elevator lobby providing access to the elevator car, or the second location device can be located within the elevator car.

In accordance with one or more embodiments or any of the above method embodiments, the first location device can be located within the elevator car.

In accordance with one or more embodiments or any of the above method embodiments, the first location device can be located within an elevator fixture.

In accordance with one or more embodiments or any of the above method embodiments, the mobile device can provide a user interface indicating a status of the multi-segment trip.

In accordance with one or more embodiments or any of the above method embodiments, the detecting of the first and second triggering signals and the automatically executing of the call by the mobile device can be hands-free operations with respect to the mobile device and a user thereof.

In accordance with one or more embodiments, an elevator system including a first location device, a second location device, and a computer including a memory and a processor is provided. The memory storing program instructions for a sequence triggering of a call for an elevator car of the elevator system thereon. The program instructions executable by the processor to cause detecting, by the first location device, a signal by the mobile device; detecting, by the second location device, the signal by the mobile device; automatically executing, by the elevator system, the call for the elevator car in response to the detection by the second location device of the signal subsequent to the detection of the signal by the first location device.

In accordance with one or more embodiments or the above system embodiment, the call for the elevator can be one of a plurality of calls of a multi-segment elevator trip within the elevator system.

In accordance with one or more embodiments or any of the above system embodiments, the program instructions can be further executable by the processor to cause an automatically executing of an initial call for a first elevator car of the elevator system in response to the detection of the signal by the first location device.

In accordance with one or more embodiments or any of the above system embodiments, the call for the elevator car can correspond to a subsequent segment of the multi-segment elevator trip, and the first call for the first elevator car can correspond to a first segment of the multi-segment elevator trip.

In accordance with one or more embodiments or any of the above system embodiments, the first location device can be located in a first elevator lobby providing access to the elevator car.

In accordance with one or more embodiments or any of the above system embodiments, the second location device can be located in a shared elevator lobby providing access to the elevator car, or the second location device can be located within the elevator car.

In accordance with one or more embodiments or any of the above system embodiments, the first location device can be located within the elevator car.

In accordance with one or more embodiments or any of the above system embodiments, the first location device can be located within an elevator fixture.

In accordance with one or more embodiments or any of the above system embodiments, the mobile device can provide a user interface indicating a status of the multi-segment trip.

In accordance with one or more embodiments or any of the above system embodiments, the detecting of the first and second triggering signals and the automatically executing of the call by the mobile device can be hands-free operations with respect to the mobile device and a user thereof.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

In accordance with one or more embodiments, a hands-free mechanism provides passengers an ability to get from any source floor to any destination floor based on sequential interactions between two or more location devices and a mobile device. For instance, the hands-free mechanism operates to determine and execute an elevator call based on an initial interaction of the mobile device with a first of the two or more location devices and a subsequent interaction of the mobile device with a second of the two or more location devices. The technical effects and benefits of the hands-free mechanism described herein include automatic calls of any elevator system, along with a hands-free user interface, for navigation in a high rise building with respect to any elevator trip, including multi-segment trips.

Figure 1:
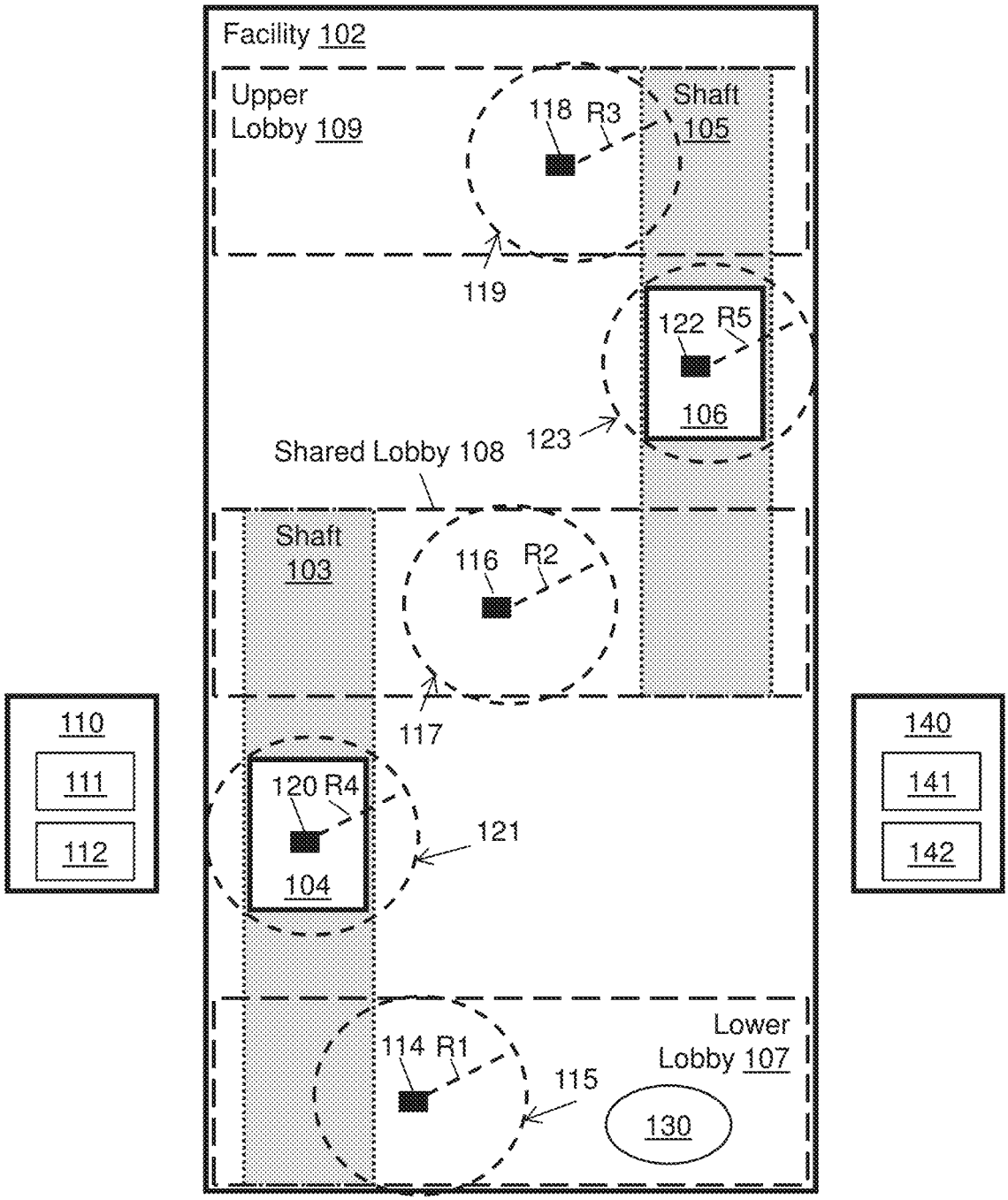
FIG. 1 depicts an environment for a sequence triggering of a call for an elevator car of an elevator system according to one or more embodiments.

FIG. 1 depicts an environment for a sequence triggering of a call for an elevator car of an elevator system according to one or more embodiments. The environment can include a facility 102 (e.g., a high rise building) comprising at least one elevator shaft supporting at least one elevator car. As shown in FIG. 1, the facility 102 includes an elevator shaft 103 supporting an elevator car 104 and an elevator shaft 105 supporting an elevator car 106. Note that the elevator car 104 can be accessed at least at a lower lobby 107 (e.g., a ground floor of the facility 102) and a shared lobby 108 (e.g., a middle floor of the facility 102). Further, note that the elevator car 106 can be accessed at least at the shared lobby 108 and an upper lobby 109 (e.g., a top floor of the facility 102). In this regard, the shaft 103 only permits the elevator car 104 to travel between a lower floor and a middle floor (which can be considered an initial segment), and the shaft 105 only permits the elevator car 106 to travel between the middle floor and a top floor (which can be considered a subsequent segment). The arrangement of elevator shafts 103 and 105 is for exemplary purposes only and any desired arrangement and number of elevator shafts and elevator cars may be used.

The environment of FIG. 1 comprises a computer 110. The computer 110 comprises a processor 111 and a memory 112. The memory 112 stores program instructions that are executable by the processor 111 to cause the operation described herein. The computer 110 can support and/or be a part of an elevator system that operates the elevator cars 104 and 105. The elevator system comprises one or more location devices.

In accordance with one or more embodiments, the one or more location devices can comprise at least a location device 114 with a location zone 115 (extending a radius R1), a location device 116 with a location zone 117 (extending a radius R2), a location device 118 with a location zone 119 (extending a radius R3), a location device 120 with a location zone 121 (extending a radius R4), and a location device 122 with a location zone 123 (extending a radius R5). The location device 114 can be located within and correspond thereto the lower lobby 107. The location device 116 can be located within and correspond thereto the shared lobby 108. The location device 118 can be located within and correspond thereto the upper lobby 109. The location device 130 can be located within and correspond thereto the elevator car 104. The location device 122 can be located within and correspond thereto the elevator car 106. Note that each radius of the location zone 115 can be predetermined and configured within the elevator system, such as at a distance of a width of the a lobby or an elevator car. The elevator system interacts with a mobile device (e.g., the mobile device 130) to provide a hands-free user interface for generating elevator calls. Moreover, any location zone and location device may be placed as desired within the environment of FIG. 1 and the elevator system, such as in an elevator fixture. In one embodiment, the location zone may be rectangular, planar, 3-dimensional, or any other desired shape.

The environment of FIG. 1 and the elevator system described herein is an example and is not intended to suggest any limitation as to the scope of use or operability of embodiments described herein (indeed additional or alternative components and/or implementations may be used). Further, while single items are illustrated for items of the environment of FIG. 1, these representations are not intended to be limiting and thus, any item may represent a plurality of items. Embodiments of the environment of FIG. 1 and the elevator system can include configurations for a mobile device centric system (e.g., when the mobile device 130 detects trigger signals from the one or more location devices), a location device centric system (e.g., when the one or more location devices detects trigger signals from the mobile device 130), or a combination thereof. Further, embodiments of the environment of FIG. 1 and the elevator system can include configurations for a lobby focused system, an elevator focused system, or a combination thereof.

The environment of FIG. 1 and the elevator system can satisfy single-segment elevator trips and multi-segment elevator trips. In accordance with one or more embodiments, if multiple event triggers are placed on a same floor, the environment of FIG. 1 and the elevator system can detect a sequence of these multiple event triggers to automatically place a single-segment trip. Further, the environment of FIG. 1 and the elevator system can determine how many elevator trip segments are required for the multi-segment trip and what guidance should be provided to a user during the multi-segment trip.

The computer 110 can include any processing hardware, software, or combination of hardware and software utilized by the elevator system to carry out computer readable program instructions by performing arithmetical, logical, and/or input/output operations. The computer 110 can be implemented local to the facility 102, remote to the facility 102, or as a cloud service. The computer 110 can be representative of a plurality of computers dispersed throughout the environment of FIG. 1 and the elevator system. The processor 111 can comprise one or more central processing units (CPU(s)), also referred to as processing circuits, coupled via a system bus to the memory 112 and various other internal or external components (e.g., the location devices 114, 116, 118, 120, and 122). The memory 112 can include a read only memory (ROM) and a random access memory (RAM). The computer 110, by utilizing the processor 111 and the memory 112, operates to provide/support automatic calls of the elevator system for navigation in the facility 102 with respect to any elevator trip. The computer 110, by utilizing the processor 111 and the memory 112, operates to support the hands-free user interface of the mobile device 130 for navigation in the facility 102 with respect to any elevator trip. The computer 110, by utilizing the processor 111 and the memory 112, can operate to communicate with the location devices 114, 116, 118, 120, and 122. The computer 110 can also determine a status of each elevator car 104 and 106, such as which floor an elevator car is located, which direction an elevator car is traveling, a number of stops designated for an elevator trip, an elevator door position, an elevator door operation (opening vs. closing), etc. The computer 110 can operate one or more timers (e.g., movement timers and disconnect timers) with respect to the operations described herein.

The location devices 114, 116, 118, 120, and 122 can be an electro-mechanical component that generates the corresponding location zones 115, 117, 119, 121, and 123. Examples of the location devices 114, 116, 118, 120, and 122 include radio devices, such as Wi-Fi devices, Bluetooth devices, wireless beacon devices, etc. The location devices 114, 116, 118, 120, and 122 can utilize software and/or firmware to carry out operations particular thereto. In this regard, the location devices 114, 116, 118, 120, and 122 can be configured to provide triggering signals (e.g., one-way communication devices advertising a location; a radio signal being broadcast to the mobile device 130). For example, the location devices 114, 116, 118, 120, and 122 themselves can provide a triggering signal to the mobile device that causes the mobile device 130 to place an elevator call, e.g., if the mobile device receives a correct event trigger sequence, with is a set of ordered interactions between the mobile device 130 and the location devices 114, 116, 118, 120, and 122.

The location devices 114, 116, 118, 120, and 122 can include transceivers (e.g., communications and/or interface adapter) that can communicate with the computer 110 and/or the mobile device 130. The location devices 114, 116, 118, 120, and 122 may communicate with the computer 110 with wires or wirelessly. In this regard, the location devices 114, 116, 118, 120, and 122 can be configured to detect the mobile device 130 (e.g., continuously sensing the mobile device 130; the mobile device 130 altering a field of the corresponding location zone) and/or communicate with the mobile device 130 with respect to the corresponding location zones 115, 117, 119, 121, and 123. For example, the location devices 114, 116, 118, 120, and 122 themselves can automatically cause the execution of an elevator call based on one or more event trigger sequences respective to interactions with the mobile device 130. Further, the location devices 114, 116, 118, 120, and 122 can generate one or more electrical signals to the computer 110 as a function of the mobile device detection (e.g., generates an electrical signal in response to detecting a presence of the mobile device 130) and/or the mobile device communication.

The mobile device 130 can include any processing hardware, software, or combination of hardware and software utilized to carry out computer readable program instructions by performing arithmetical, logical, and/or input/output operations. The mobile device 130 can include any wireless device operated by a passenger, such as a laptop, a table computer, a mobile phone, a smartphone, a wireless beacon on the user (e.g., an electronic bracelet), radio frequency identification card, smartwatches, implants, smart glasses, wearable components, and the like. The mobile device 130 can interact/detect/communicate with the one or more location devices of the elevator system, can support/provide/execute an application and a hands-free user interface, and can connect to the computer 110 or a cloud server 140 (wirelessly through an internet, cellular, or cloud connection).

The cloud server 140, comprising a processor 411 and a memory 142 as described herein, can include any processing hardware, software, or combination of hardware and software in communication with the mobile device 130 to carry out computer readable program instructions by performing arithmetical, logical, and/or input/output operations. The cloud server 140 can be implemented local to the facility 102, remote to the facility 102, or as a cloud service to the mobile device 130. The cloud server 140, by utilizing the processor 141 and the memory 142, operates to support automatic calls executed by the mobile device 130.

In accordance with one or more embodiments, the mobile device 130 executes elevator calls in response to one or more event trigger sequences based on a logic in the application (to interpret a correct sequence). The application allows the mobile device 130 to send messages via cellular towers or other communication means (provide information over the internet to cloud-based internet servers, such as the cloud server 140). The cloud server 140 can in turn send elevator requests to the elevator controllers (e.g., the computer 110) in a specific building (e.g., the facility 102). Thus, the mobile device 130 detecting a trigger at one of the lobbies 107, 108, and 109 or within the elevator car 104 or 106 is able to send a message through a cellular network that eventually is received by the elevator system. Further, the logic in the application can store default, preset, and/or manual entries of floor destinations with respect to a user profile within the application and can cause the execution of elevator calls based on these entries as the mobile device 130 interacts with the environment of FIG. 1 and the elevator system. In accordance with one or more embodiments, the mobile device 130 outputs a unique signal identifying the mobile device 130 to the location devices 114, 116, 118, 120, and 122 to provide one or more event trigger sequences to the environment of FIG. 1 and the elevator system. An event trigger sequence is a set of ordered interactions between the mobile device and the location devices 114, 116, 118, 120, and 122. The elevator system can also operate automatic calls based on sequential detections of the mobile device 130 (e.g., an event trigger sequence). In this regard, the elevator system can execute each segment request internally, while a user is continuously notified of each elevator assignment without user confirmation (e.g., hands-free operation).

In accordance with one or more embodiments, the environment of FIG. 1 and the elevator system herein can be applied to non-smartphone type systems where a passenger's identity is automatically detected via biometric scans or other means (the same resulting multi-segment trip call could be executed). For example, if a video analytics system is in-place at each floor, a process flow can be executed where if a user is detected on the lower lobby 107 and then the user is detected in elevator 104, then an elevator call for the elevator 106 is automatically placed for the user at shared lobby 108.

Figure 2:
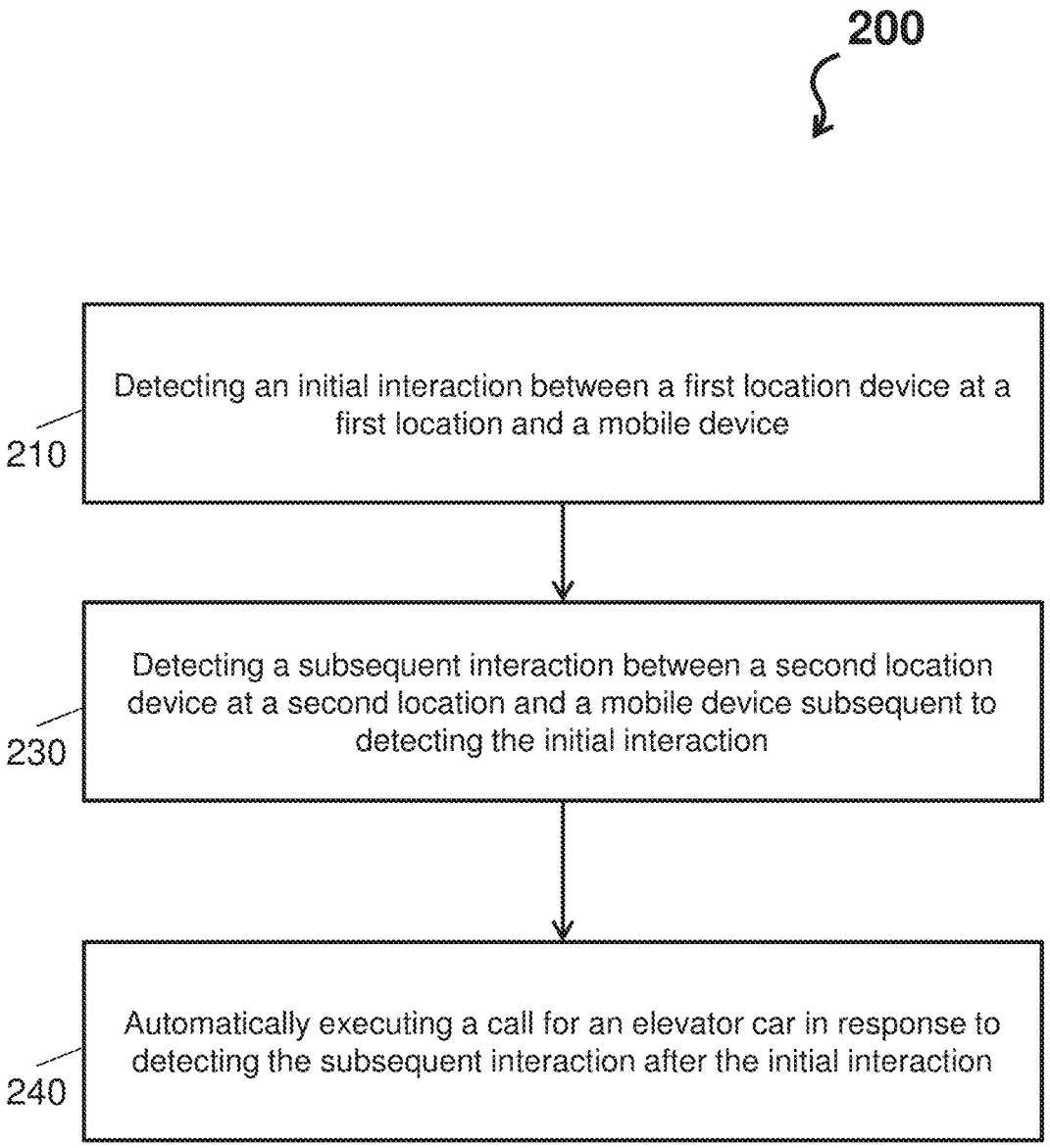
FIG. 2 depicts a process flow of an elevator system according to one or more embodiments.

Turning now to FIG. 2, a process flow 200 of the elevator system is depicted according to one or more embodiments. The process flow 200 is an example operation to determine and execute an elevator call based on an initial interaction of the mobile device 130 with a first of the two or more location devices and a subsequent interaction of the mobile device 130 with a second of the two or more location devices (e.g., an event trigger sequence). Note that any combination of at least two location devices of the elevator system can be utilized to construct an event trigger sequence to implement the process flow 200.

For instance, the process flow 200 can utilize the following location device combinations in a lobby focused system to the construct the event trigger sequences of (1L) a location device 114 interaction followed by a location device 116 interaction and (2L) a location device 118 interaction followed by a location device 116 interaction.

Further, the process flow 200 can utilize the following location device combinations in an elevator focused system to the construct the event trigger sequences of (1E) a location device 120 interaction followed by a location device 122 interaction and (2E) a location device 122 interaction followed by a location device 120 interaction.

Furthermore, the process flow 200 can utilize the following location device combinations in a joint lobby-elevator system to the construct the event trigger sequences of (1C) a location device 114 interaction followed by a location device 120 interaction, (2C) a location device 116 interaction followed by a location device 122 interaction, (3C) a location device 118 interaction followed by a location device 122 interaction, and (4C) a location device 116 interaction followed by a location device 120 interaction, along with utilizing the combinations (1L), (2L), (1E), and (2E) described herein. Note that any three or more interaction combination are also configurable.

For ease of explanation, the process flow 200 is now described with respect to a lobby focused system where the first and second location devices respectively align with the event trigger sequences of (1L) the location device 114 interaction followed by the location device 116 interaction.

The process flow 200 begins at block 210, with a detection of an initial interaction between a first location device at a first location and a mobile device. In accordance with one or more embodiments, the first location device can be the location device 114, and the first location can be the lower lobby 107. In a mobile device centric system, the initial interaction can include the mobile device 130 detecting a one-way triggering signal by the location device 114, which the mobile device 130 determines as a first event in the event trigger sequence. In a location device centric system, the initial interaction can alternatively be the location device 114 detecting the mobile device 130, which is determined by the location device 114 or the computer 110 as the first element in an event trigger sequence.

At block 230, a detection of a subsequent interaction between a second location device at a second location and a mobile device occurs. In accordance with one or more embodiments, the second location device can be the location device 116, and the second location can be the shared lobby 108. In the mobile device centric system, the subsequent interaction can include the mobile device 130 detecting a one-way triggering signal by the location device 116, which the mobile device 130 determines as a second event in the event trigger sequence. In the location device centric system, the subsequent interaction can alternatively be the location device 116 detecting the mobile device 130, which is determined by the location device 116 or the computer 110 as the second element in an event trigger sequence.

At block 240, the elevator system automatically executes a call for an elevator car in response to detecting the subsequent interaction after the initial interaction. For example, in the mobile device centric system, the mobile device 130 can communicate to the computer 110 to execute a call for the elevator 106 to retrieve a passenger operating the mobile device 130 in the shared lobby 108. In the location device centric system, after the computer 110 receives triggering events from the location device 114 and the location device 116 in order, the computer 110 can execute a call for the elevator 106 to retrieve a passenger operating the mobile device 130 in the shared lobby 108.

Figure 3:
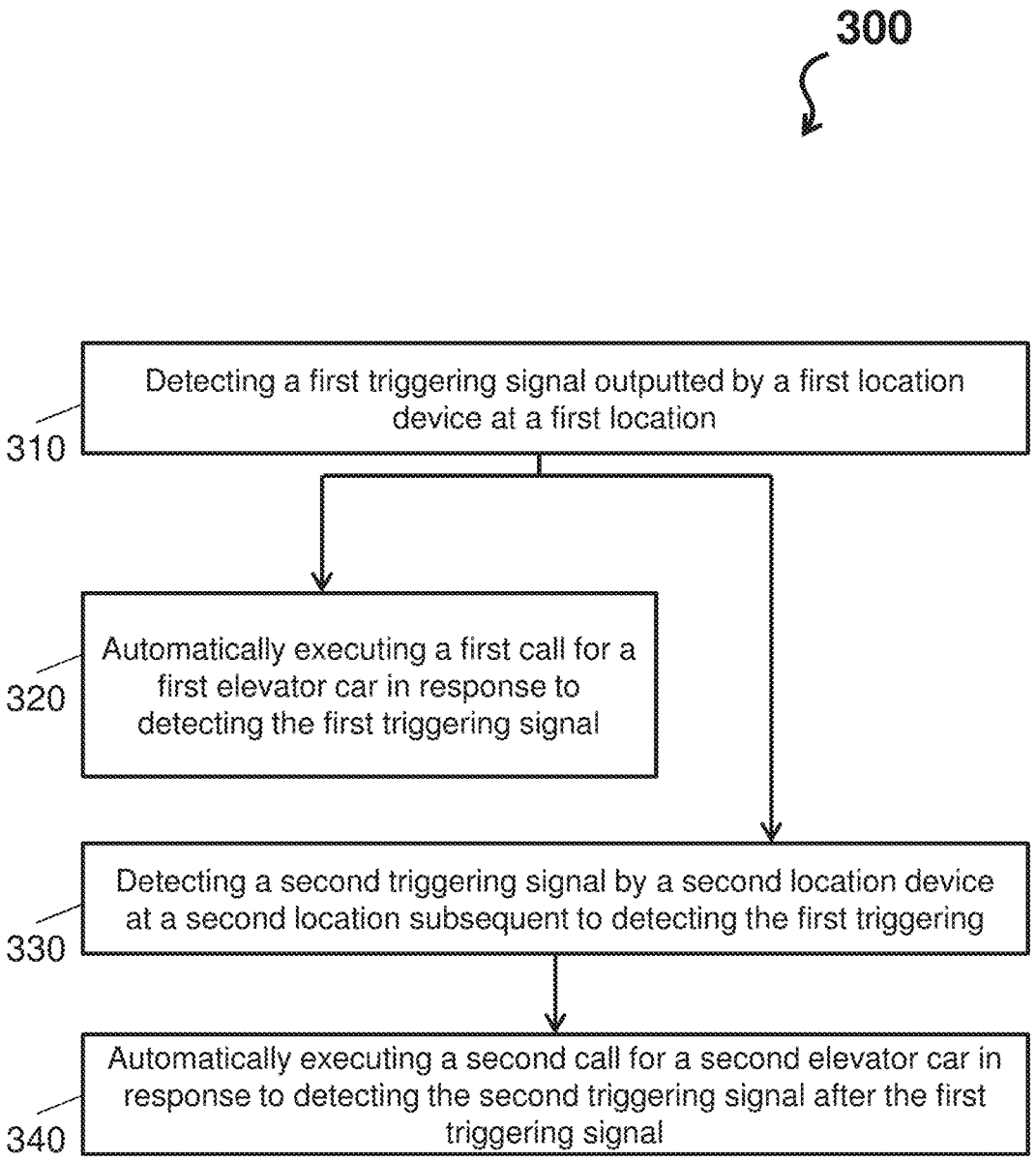
FIG. 3 depicts a process flow of an elevator system according to one or more embodiments.

Turning now to FIG. 3, a process flow 300 of the elevator system is depicted according to one or more embodiments. The process flow 300 is an example operation to determine and execute multiple elevator calls for a multi-segment trip based on at least two sequential interactions between the mobile device 130 and at least two location devices 114, 116, 118, 120, and 122. Note that any combination of the at least two location devices 114, 116, 118, 120, and 122 of the elevator system can be utilized to implement the process flow 300.

For ease of explanation, the elevator system implementing the process flow 300 is described as a combined mobile device centric and lobby focused system. Further, the mobile device 130 includes thereon the (1L) event trigger sequence: the location device 114 interaction followed by the location device 116 interaction.

The process flow 300 begins at block 310, where a detection of a first triggering signal outputted by a first location device at a first location. In accordance with one or more embodiments, the first location device can be the location device 114, and the first location can be the lower lobby 107. The detection (an interaction as described herein) of the location device 114 can be by the mobile device 130.

The process flow proceeds to both blocks 320 and 330. At block 320, a first call for a first elevator car is automatically executed in response to the detection of the first triggering signal. For example, the mobile device 130 can communicate to the computer 110 to execute a call for the elevator 104 to retrieve a passenger operating the mobile device 130 in the lower lobby 107.

At block 330, a detection of a second triggering signal outputted by a second location device at a second location occurs. In accordance with one or more embodiments, the second location device can be the location device 116, and the second location can be the shared lobby 108. The detection (an interaction as described herein) of the location device 116 can be by the mobile device 130.

At block 340, a second call for a second elevator car is automatically executed in response to the detection of the second triggering signal after the first triggering signal. For example, the mobile device 130 can communicate to the computer 110 to execute a call for the elevator 106 to retrieve a passenger operating the mobile device 130 in the shared lobby 108 because the (1L) event trigger sequence was detected by the mobile device 130.

Figure 4:
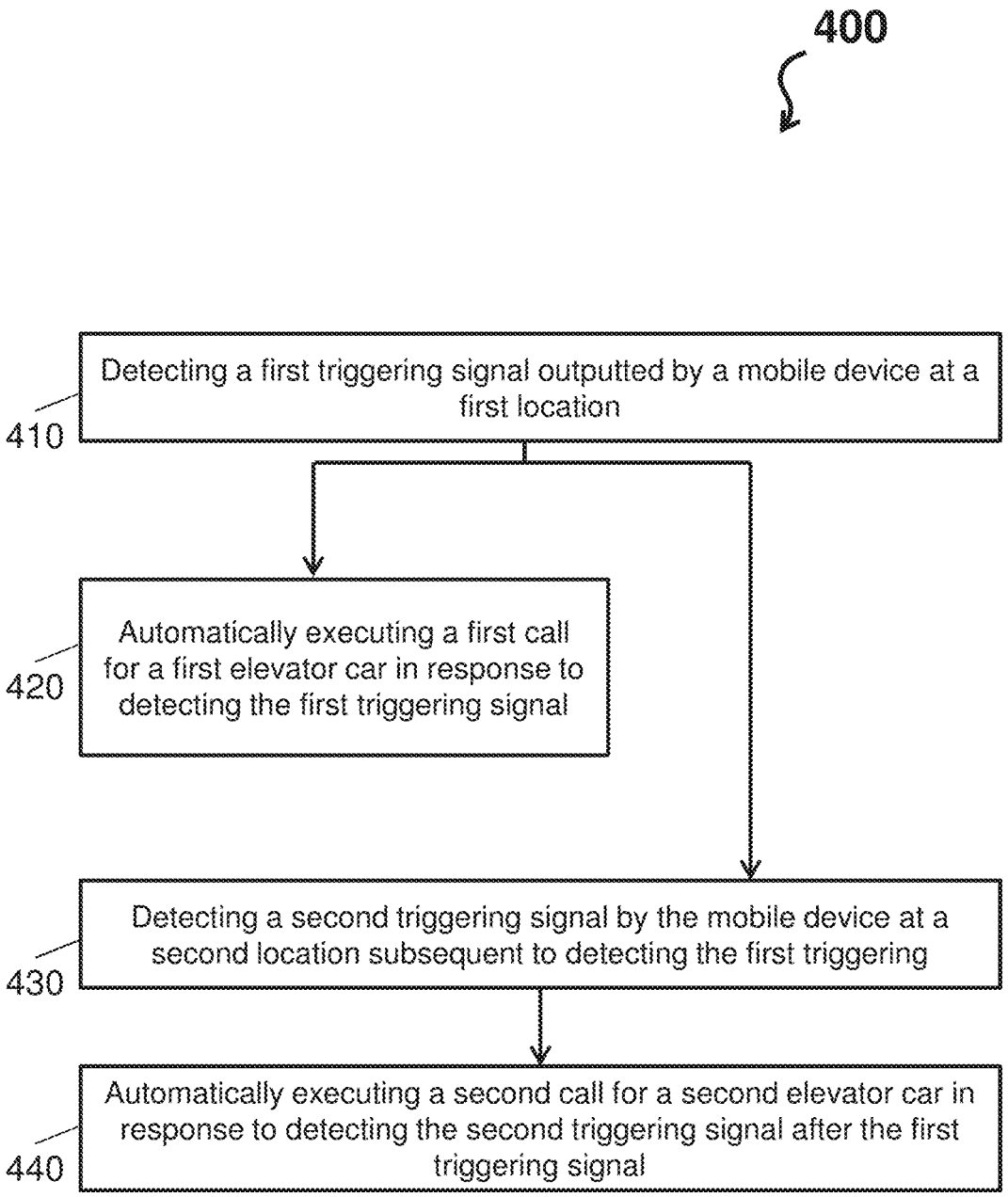
FIG. 4 depicts a process flow of an elevator system according to one or more embodiments.

Turning now to FIG. 4, a process flow 400 of the elevator system is depicted according to one or more embodiments. The process flow 400 is an example operation to determine and execute multiple elevator calls for a multi-segment trip based on at least two sequential interactions between the mobile device 130 and at least two location devices 114, 116, 118, 120, and 122. Note that any combination of the at least two location devices 114, 116, 118, 120, and 122 of the elevator system can be utilized to implement the process flow 400.

For ease of explanation, the elevator system implementing the process flow 400 is described as a combined location device centric and lobby focused system. Further, the computer 110 includes thereon the (1L) event trigger sequence: the location device 114 interaction followed by the location device 116 interaction.

The process flow 400 begins at block 410, where a detection of a first triggering signal outputted by the mobile device 130 at a first location. In accordance with one or more embodiments, the first location can be the lower lobby 107, and the detection (an interaction as described herein) of the mobile device 130 can be by the location device 114.

The process flow proceeds to both blocks 420 and 430. At block 420, a first call for a first elevator car is automatically executed in response to the detection of the first triggering signal. For example, the location device 114 can communicate to the computer 110 to execute a call for the elevator 104 to retrieve a passenger operating associated with the mobile device 130 in the lower lobby 107.

At block 430, a detection of a second triggering signal outputted by the mobile device 130 at a second location occurs. In accordance with one or more embodiments, the second location can be the shared lobby 108, and the detection (an interaction as described herein) of the mobile device 130 can be by the location device 116.

At block 440, a second call for a second elevator car is automatically executed in response to the detection of the second triggering signal after the first triggering signal. For example, the location device 116 can communicate to the computer 110 to execute a call for the elevator 106 to retrieve a passenger associated with the mobile device 130 in the shared lobby 108 because the (1L) event trigger sequence was detected by the elevator system 100.

Figure 5:
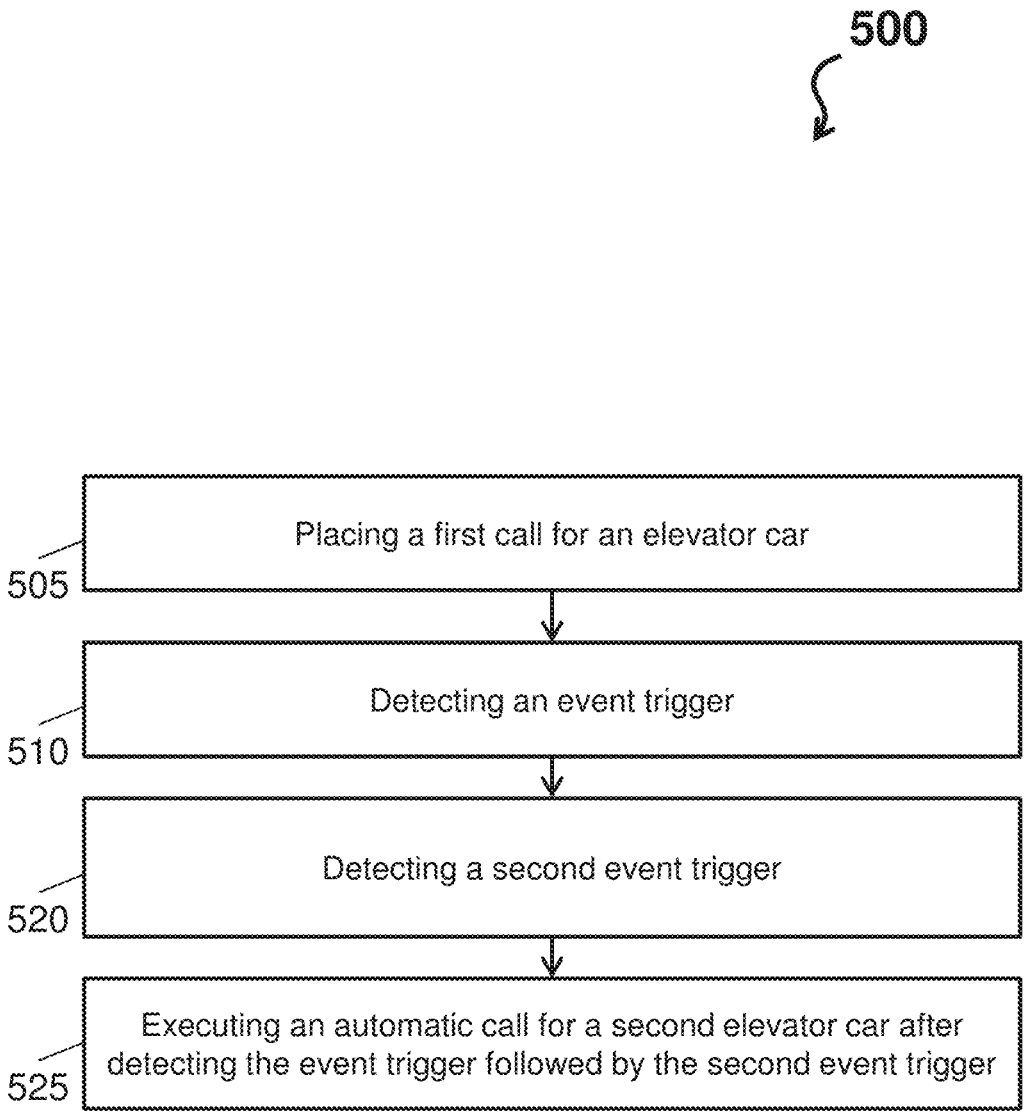
FIG. 5 depicts a process flow of an elevator system according to one or more embodiments.

Turning now to FIG. 5, a process flow 500 of the elevator system is depicted according to one or more embodiments. For ease of explanation, the elevator system implementing the process flow 500 is described as a combined mobile device centric and joint lobby-elevator system.

The process flow 500 begins at block 505, where a first call (e.g., from Floor 1 to Floor 35) for the first elevator car (e.g., the elevator car 104) can be placed from an elevator fixture in a main lobby (e.g., the lower lobby 107) or via the application of the mobile device 130. At block 510, the mobile device 130 detects an event trigger (e.g. Beacon A represented by the location device 120) upon entry to the first elevator car. Note that the event triggers could be a series of multiple triggers (i.e., not just one Beacon B, but multiple Beacons like B) to increase confidence to not only suggest the call, but automatically place the call without user confirmation. Further, if a fixture, equipment, or building has a series of multiple triggers on a floor, these can be used to compensate for error cases. For example, a detection of by a single Beacon B in the shared lobby 108 alone is not enough to trigger a call, since it is not known whether a passenger desires to travel up or down. The series of multiple Beacon B's can interpret an intent of the user by an inferred location of the mobile device 130 as the mobile device 130 passes through the shared lobby 108.

At block 520, the mobile device 130 detects a second event trigger (e.g. Beacon B represented by the location device 116) upon leaving the first elevator car on a sky lobby (e.g., the shared lobby 408). At block 525, an automatic call is executed for a second elevator car (e.g., the elevator car 406) after detecting the event trigger followed by the second event trigger (e.g., a correct event trigger sequence). For example, the correct event trigger sequence can include if Beacon A is detected and Beacon B is detected subsequent thereto. In turn, a second call is placed from, e.g., Floor 35 to Floor 52. The automatic call can be suggested or placed for the second elevator car by the application on the mobile device 130.

Figure 6:
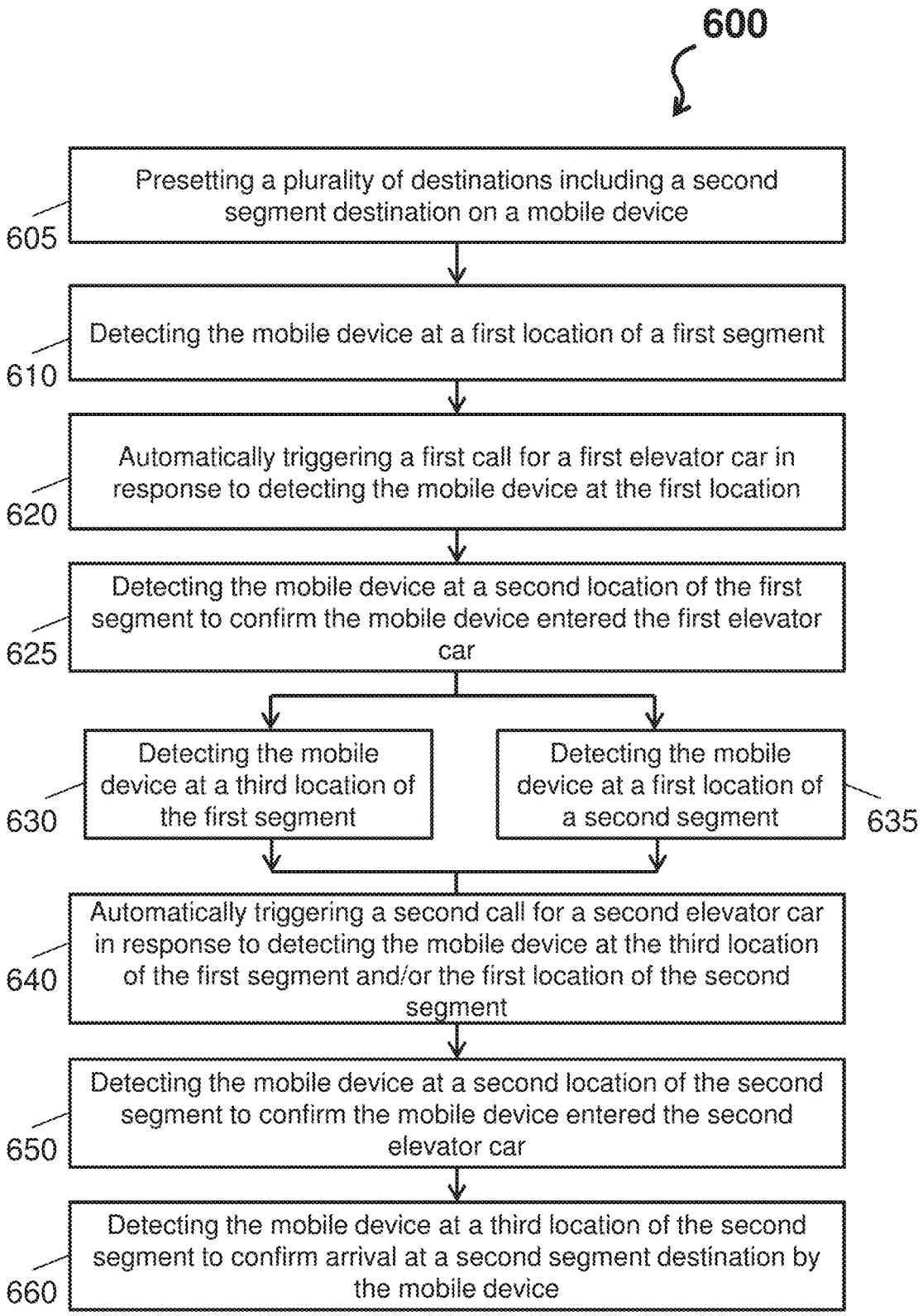
FIG. 6 depicts a process flow of an elevator system according to one or more embodiments.

Turning now to FIG. 6, a process flow 600 of an elevator system is depicted according to one or more embodiments. For ease of explanation, the elevator system implementing the process flow 600 is described as a combined location device centric and joint lobby-elevator system. The process flow 600 illustrates a two-segment elevator trip (that automatically happens with minimal interaction from the user) from the lower lobby 107 (e.g., a main lobby) to the shared lobby 108 (e.g., a sky lobby) and then to a final destination at a passenger's office, resident on a floor above the shared lobby 108 accessed by the upper lobby 109. For example, the main lobby can be located on Floor 1, the sky lobby can be located at Floor 35, and the final destination can be located at Floor 50. The shaft 103 only permits the elevator car 104 to travel along a range from the main lobby to the sky lobby (e.g., a first segment includes any floor along the range), while the shaft 105 only permits the elevator car 106 to travel along a range from the sky lobby to segment two lobby 109 (e.g., a second segment includes any floor along the range). In accordance to one or more embodiments, the shafts 103 and 105 can also be implemented as express zones for allowing the corresponding elevator cars 104 and 106 to directly travel between certain floors of their respective segments.

The process flow 600 begins at block 605, where a plurality of destinations including a second segment destination are preset on the mobile device 130. In this regard, when the mobile device 130 is detected in a location other then at the second segment destination, the elevator system can determine or infer that a user of the mobile device 130 desires to go to the second segment destination.

At block 610, the elevator system detects the mobile device 130 at a first location of a first segment. For example, the location device 114 detects the mobile device 130 approaching a door to the shaft 103. At block 620, the elevator system automatically triggers a first call for a first elevator car (e.g., the elevator car 104) in response to detecting the mobile device 130 at the first location. At block 625, the elevator system detects the mobile device 130 at a second location of the first segment to confirm the mobile device 130 entered the first elevator car. For example, the location device 120 detects the mobile device 130 entering and residing within the elevator car 104. The process flow 600 then proceeds to one or more of blocks 630 and 635.

At block 630, the elevator system detects the mobile device 130 at a third location of the first segment. For example, the location device 116 detects the mobile device 130 exiting the elevator car 104 and moving into the shared lobby 108. At block 635, the elevator system detects the mobile device 130 at a first location of a second segment. For example, the location device 116 detects the mobile device 130 moving across the shared lobby 108 and approaching a door to the shaft 105.

At block 640, the elevator system automatically triggers a second call for a second elevator car (e.g., the elevator car 106) in response to detecting the mobile device 130 at the first location of the second segment. At block 650, the elevator system detects the mobile device 130 at a second location of the second segment to confirm the mobile device 130 entered the second elevator car. For example, the location device 122 detects the mobile device 130 entering and residing within the elevator car 106.

At block 660, the elevator system detects the mobile device 130 at a third location of the second segment to confirm arrival at a second segment destination by the mobile device 130. For example, the location device 118 detects the mobile device 130 exiting the elevator car 106 and moving into the upper lobby 109 (e.g., the second segment destination).

Figure 7:
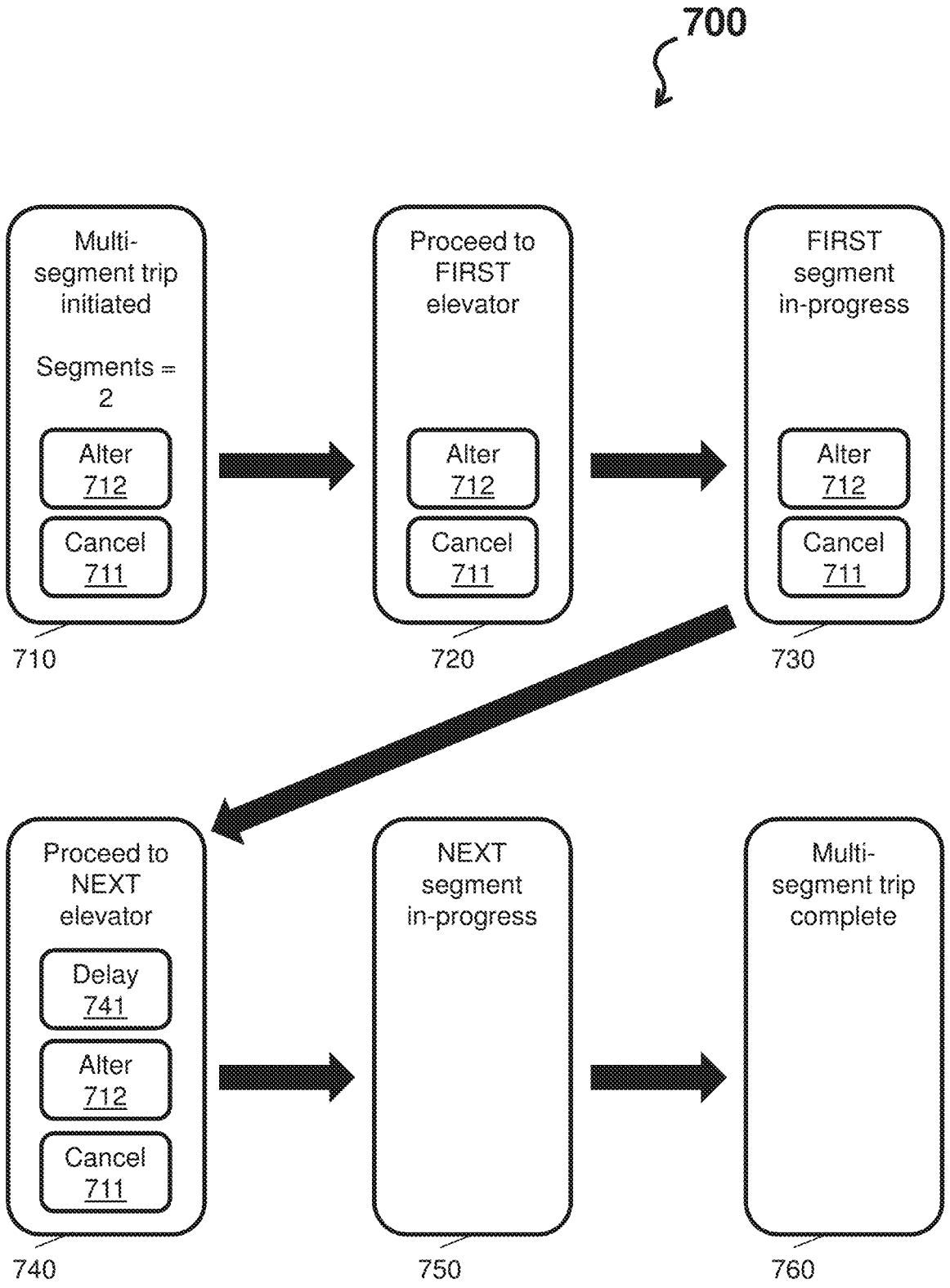
FIG. 7 depicts a process flow of user interface of a mobile device according to one or more embodiments.

FIG. 7 depicts a process flow 700 of user interface of a mobile device according to one or more embodiments. The user interface provides a hands-free solution for providing a status of a multi-segment trip. The user interface is supported by software of the mobile device. As shown in FIG. 7, that user interface can progress through one or more stages as the status of the multi-segment trip changes. A first stage 710 of the user interface indicates that the multi-segment trip has been initiated (e.g., 'multi-segment trip initiated') and indicates a number of segments (e.g., 'Segments=2'). The first stage 710 of the user interface also includes a cancel button 711 and an alter button 712. The cancel button 711 allows a user to cancel the multi-segment trip. The alter button 712 allows a user to view and change the destinations and segments of the multi-segment trip.

A second stage 720 of the user interface indicates an instruction to the user to board the first elevator (e.g., 'Proceed to FIRST elevator'). A third stage 730 of the user interface indicates a status to the user that the first elevator is traveling and completing the first segment (e.g., 'FIRST segment in-progress'). A fourth stage 740 of the user interface indicates an instruction to the user to board the next elevator (e.g., 'Proceed to NEXT elevator'). The fourth stage 740 of the user interface includes a delay button 741. The delay button 741 can cause the multi-segment trip to toll, while the user perform another activity before proceeding. The delay can be seconds or minutes.

A fifth stage 750 of the user interface indicates a status to the user that the next elevator is traveling and completing the second segment (e.g., 'NEXT segment in-progress'). A second stage 760 of the user interface indicates that the multi-segment trip has been completed (e.g., 'Multi-segment trip complete), Note that the fifth stage 750 and the sixth stage 760 do not include the cancel button 711 or the alter button 712 because the last segment of the multi-segment trip is being performed and there is nothing to alter or cancel.

In view of the description herein, the following embodiments are further detailed.

In accordance with one or more embodiments, a computer-implemented method for a sequence triggering of automatic calls for a multi-segment elevator trip for a mobile device within an elevator system is provided. The elevator system includes a first location device and a second location device. The computer-implemented method includes detecting, by the first location device, the mobile device. The elevator system includes detecting, by the second location device, the mobile device subsequent to the first location device detecting the mobile device. The elevator system includes automatically triggering, by the elevator system, a call for an elevator car of the elevator system in response to the second location device detecting the mobile device. The call for the elevator car corresponds to a subsequent segment of the multi-segment elevator trip.

In accordance with one or more embodiments or the computer-implemented method embodiment above, the computer-implemented method can further comprise automatically triggering, by the elevator system, a first call for a first elevator car of the elevator system in response to the first location device detecting the mobile device, where the first call for the first elevator car can correspond to a first segment of the multi-segment elevator trip.

In accordance with one or more embodiments or any of the computer-implemented method embodiments above, the second location device can be located in a shared elevator lobby providing access to the elevator car and a first elevator car, or the first location device can be located in a first elevator lobby providing access to a first elevator car.

In accordance with one or more embodiments or any of the computer-implemented method embodiments above, the second location device can be located the elevator car, or the first location device can be located within a first elevator car.

In accordance with one or more embodiments or any of the computer-implemented method embodiments above, the mobile device can store at least a subsequent segment destination, detecting the mobile device by the first location device can automatically initiate the multi-segment trip with respect to the subsequent segment destination, the first location device can be located within a first segment of the multi-segment trip, and the second location device can be located within the subsequent segment of the multi-segment trip.

In accordance with one or more embodiments or any of the computer-implemented method embodiments above, detecting of the mobile device by the first and second location devices and the automatic triggering of the call by the elevator system can be hands-free operations with respect to the mobile device and a user thereof.

In accordance with one or more embodiments or any of the computer-implemented method embodiments above, the mobile device can provide a user interface indicating a status of the multi-segment trip.

In accordance with one or more embodiments, any of the above methods can be implemented in a system and/or a computer program product including a computer readable storage medium having program instructions.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A computer-implemented method for a sequence triggering of a call for an elevator car of an elevator system, the elevator system comprising a first location device and a second location device, the computer-implemented method comprising:

detecting, by the first location device, a signal by a mobile device;

detecting, by the second location device, the signal by the mobile device;

automatically executing, by the elevator system, the call for the elevator car in response to the detection by the second location device of the signal subsequent to the detection of the signal by the first location device;

wherein the call for the elevator is one of a plurality of calls of a multi-segment elevator trip within the elevator system.

2. The computer-implemented method of claim 1, wherein the computer-implemented method further comprising automatically executing an initial call for a first elevator car of the elevator system in response to the detection of the signal by the first location device.

3. The computer-implemented method of claim 2, wherein the call for the elevator car corresponds to a subsequent segment of the multi-segment elevator trip, and wherein the first call for the first elevator car corresponds to a first segment of the multi-segment elevator trip.

4. The computer-implemented method of claim 1, wherein the first location device is located in a first elevator lobby providing access to the elevator car.

5. The computer-implemented method of claim 4, wherein the second location device is located in a shared elevator lobby providing access to the elevator car, or wherein the second location device is located within the elevator car.

6. The computer-implemented method of claim 1, wherein the first location device is located within the elevator car.

7. The computer-implemented method of claim 1, wherein the first location device is located within an elevator fixture.

8. The computer-implemented method of claim 1, wherein detecting of the first and second triggering signals and the automatically executing of the call by the mobile device are hands-free operations with respect to the mobile device and a user thereof.

9. A computer-implemented method for a sequence triggering of a call for an elevator car of an elevator system, the elevator system comprising a first location device and a second location device, the computer-implemented method comprising:

detecting, by the first location device, a signal by a mobile device;

detecting, by the second location device, the signal by the mobile device;

automatically executing, by the elevator system, the call for the elevator car in response to the detection by the second location device of the signal subsequent to the detection of the signal by the first location device;

wherein the mobile device provides a user interface indicating a status of the multi-segment trip.

10. An elevator system comprising a first location device, a second location device, and a computer comprising a memory and a processor, the memory storing program instructions for a sequence triggering of a call for an elevator car of the elevator system thereon, the program instructions executable by the processor to cause:

detecting, by the first location device, a signal by a mobile device;

detecting, by the second location device, the signal by the mobile device;

automatically executing, by the elevator system, the call for the elevator car in response to the detection by the second location device of the signal subsequent to the detection of the signal by the first location device;

wherein the call for the elevator is one of a plurality of calls of a multi-segment elevator trip within the elevator system.

11. The elevator system of claim 10, wherein the program instructions are further executable by the processor to cause an automatically executing of an initial call for a first elevator car of the elevator system in response to the detection of the signal by the first location device.

12. The elevator system of claim 11, wherein the call for the elevator car corresponds to a subsequent segment of the multi-segment elevator trip, and wherein the first call for the first elevator car corresponds to a first segment of the multi-segment elevator trip.

13. The elevator system of claim 10, wherein the first location device is located in a first elevator lobby providing access to the elevator car.

14. The elevator system of claim 13, wherein the second location device is located in a shared elevator lobby providing access to the elevator car, or wherein the second location device is located within the elevator car.

15. The elevator system of claim 10, wherein the first location device is located within the elevator car.

16. The elevator system of claim 10, wherein the first location device is located within an elevator fixture.

17. The elevator system of claim 10, wherein detecting of the first and second triggering signals and the automatically executing of the call by the mobile device are hands-free operations with respect to the mobile device and a user thereof.

18. An elevator system comprising a first location device, a second location device, and a computer comprising a memory and a processor, the memory storing program instructions for a sequence triggering of a call for an elevator car of the elevator system thereon, the program instructions executable by the processor to cause:

detecting, by the first location device, a signal by a mobile device;

detecting, by the second location device, the signal by the mobile device;

automatically executing, by the elevator system, the call for the elevator car in response to the detection by the second location device of the signal subsequent to the detection of the signal by the first location device;

wherein the mobile device provides a user interface indicating a status of the multi-segment trip.

* * * * *